US009476667B2

(12) United States Patent
Pedersen

(10) Patent No.: US 9,476,667 B2
(45) **Date of Patent: *Oct. 25, 2016**

(54) MATING ARROW MOUNTED SLIDE AND ARROW REST CRADLE ASSEMBLY FOR BOWFISHING AND BOWHUNTING

(71) Applicant: Out RAGE, LLC, Cartersville, GA (US)

(72) Inventor: William E. Pedersen, Duluth, MN (US)

(73) Assignee: Out RAGE, LLC, Superior, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/854,965

(22) Filed: Sep. 15, 2015

(65) Prior Publication Data

US 2016/0003574 A1 Jan. 7, 2016

Related U.S. Application Data

(63) Continuation of application No. 13/987,405, filed on Jul. 22, 2013, now Pat. No. 9,163,898.

(51) Int. Cl.

| | |
|---|---|
| ***F41B 5/00*** | (2006.01) |
| ***F41B 5/14*** | (2006.01) |
| ***F42B 6/04*** | (2006.01) |

(52) U.S. Cl.

CPC ..... *F41B 5/143* (2013.01); *F41B 5/148* (2013.01); *F41B 5/1484* (2013.01); *F41B 5/1488* (2013.01); *F42B 6/04* (2013.01)

(58) Field of Classification Search

CPC ..... F41B 5/143; F41B 5/1488; F42B 6/04

See application file for complete search history.

(56) References Cited

U.S. PATENT DOCUMENTS

| | | | | |
|---|---|---|---|---|
| 4,020,984 | A | 5/1977 | Morris | |
| 4,027,645 | A | 6/1977 | Damron | |
| 4,156,496 | A | 5/1979 | Stinson | |
| 4,252,101 | A | 2/1981 | Spitzke | |
| 4,829,974 | A | 5/1989 | Anderson | |
| 4,958,617 | A | 9/1990 | Anderson | |
| 5,215,070 | A | 6/1993 | Brown | |
| 5,311,855 | A | 5/1994 | Basik | |
| 5,520,163 | A | 5/1996 | Hurd | |
| 5,803,069 | A | 9/1998 | Schreiber | |
| 6,390,085 | B1 | 5/2002 | Stinson | |
| 6,517,453 | B2 | 2/2003 | LaSee | |
| 6,564,791 | B1 | 5/2003 | Hammen | |
| 6,672,299 | B2 | 1/2004 | Proctor | |
| 6,691,694 | B2 | 2/2004 | Stinson | |
| 6,845,765 | B1 | 1/2005 | Allshouse et al. | |
| 7,464,908 | B2 | 12/2008 | Files | |
| 7,987,842 | B2 | 8/2011 | McPherson | |
| 9,109,852 | B1 * | 8/2015 | Boester | F41B 5/1488 |
| 9,163,898 | B2 * | 10/2015 | Pedersen | F41B 5/1488 |
| 9,228,812 | B1 * | 1/2016 | White | F42B 6/04 |
| 2003/0140913 | A1 | 7/2003 | Stinson | |
| 2006/0112945 | A1 | 6/2006 | Rager | |
| 2008/0251059 | A1 | 10/2008 | McPherson | |
| 2008/0302346 | A1 | 12/2008 | Notestine | |

* cited by examiner

*Primary Examiner* — John Ricci
(74) *Attorney, Agent, or Firm* — Winthrop & Weinstine

(57) ABSTRACT

A mating arrow mounted slide and arrow rest cradle assembly for bowfishing and bowhunting utilizes an arrow shaft mounted slide that is releasably snapped into a cradle carried by the riser of a bow, in which the slide cradle combination provides a tight arrow rest as well as an anchoring mechanism for one end of a line when used for bowfishing. When the arrow is released the slide unsnaps from the cradle and moves in unison with the arrow as the arrow moves out of the bow.

6 Claims, 15 Drawing Sheets

MATING ARROW MOUNTED SLIDE AND ARROW REST CRADLE ASSEMBLY FOR BOWFISHING AND BOWHUNTING

CROSS-REFERENCE TO RELATED APPLICATIONS

This application is a continuation, and claims the benefit, under 35 U.S.C. §120, of U.S. patent application Ser. No. 13/987,405, filed Jul. 22, 2013, which is herein incorporated by reference in its entirety.

FIELD OF THE INVENTION

This invention relates to bowfishing and bowhunting and more particularly to a mating slide cradle combination for use in bowfishing and bowhunting.

BACKGROUND OF THE INVENTION

It will be appreciated that one of the challenges in bowfishing is that one is typically bowfishing from an unstable platform such as a small boat, canoe or kayak. In this case appropriate positioning of the slide on the arrow is difficult as the platform is moving around. Moreover, one often leans over at an awkward angle from an embankment when bowfishing, again preventing positioning of the slide. The result is that when bowfishing one is typically firing the arrow at an unusual or unnatural shooting angle. This means that the arrow cannot easily be maintained against the bow riser and potentially result in misfiring.

Because of the instability of the platform, be it a canoe, kayak or the like or because of the awkward firing angle, oftentimes the little arm that hangs over the side of the bow riser and serves as a simple arrow rest is insufficient to maintain the arrow in the appropriate position against the riser. This is true when one leans around or moves around when taking a shot. The result is that when the arrow comes out of the simple arrow rest, the arrow and the fishing line can kick around so as to be dangerous, especially when one is trying to position himself for a shot from an awkward position. Thus the arrow will oftentimes come out of the arrow rest and if such occurs there is a serious risk of injury to either fisherman, hunter, other members of the party and potentially even the boat.

While in bowhunting and in bowfishing there are full containment rests, they have large annuli. The problem is that the arrow can slip around in the full containment rest which changes the rest point and changes the angle of the arrow.

Moreover, since the full containment rest lets one change the angle of the bow from vertical to as much as 30 degrees as one is bending over, these full containment arrow rests do not produce a reliable shot.

Thus, in addition the problem of safety of the arrow coming out of a simple arrow rest, there is also the problem of the arrow moving around in a full containment arrow rest which can cause the arrow to go off target.

By way of background, as described in U.S. Pat. No. 6,517,453 a slide is provided on an arrow to which is attached a fishing line. The purpose of a bowfishing slide is to make sure the string or line attached to the arrow to retrieve a fish stays in front of the handle so that when the arrow is released there is no change of being caught up in the string.

It will be noted that the line or a string allows one to retrieve the arrow and fish or quarry that one is shooting at.

It might be thought that one could simply use a traditional arrow and attach the string or line at the front of the arrow. However if one attaches the string at the front of the arrow it will cause the arrow to deflect sideways in flight. If however one attaches it at the rear of the arrow, the arrow is much more aerodynamically and hydrodynamically stable.

The problem however is that the string that is attached to the end of the arrow may come all the way back by the person's face as they are drawing the bow. When the string is flung forward after arrow release it can potentially come in contact with the person's face or hand or arm. From the above patent it can be seen that a slide is mounted on the arrow with the line attached, with the slide to always be in front of the bow handle. After release the slide moves forward and travels on the arrow, with the string or the line attached to the slide for retrieval. It is noted that the trailing edge of the arrow is provided with a stop that contacts the slide as the arrow moves away from the bow such that the arrow and the slide move forward in unison.

As will be appreciated the attachment of the line to the rearmost of the arrow provides better aerodynamic stability than one would have if one did not have the slide.

The embodiment in the '453 patent has the slide positioned on the arrow ahead of the riser or bow handle so that line cannot get tangled in the hunter's or archer's hand or otherwise get tangled in elements of the bow. Thus, safety is provided because the line is always in front of the bow riser. However it is only with difficulty that this critical positioning can be maintained. This is because there is nothing to prevent the slide from sliding aft past the riser when the arrow in place. Additionally, the '453 patent embodiment does not constrain the arrow, and allows for the arrow to be displaced from the riser as previously described.

SUMMARY OF INVENTION

Rather than providing a slide translatable on an arrow shaft ahead of a riser, in the subject invention a slide is provided which is snapped into a cradle carried on the bow riser in which the cradle is aft of the riser. When the arrow is snapped into the cradle in this manner the arrow does not move around and safety concerns are considerably diminished especially for unstable platforms such as occur in bowfishing.

In one embodiment the cradle is provided with a deformable member such as a rubber piece which communicates with a notch on the slide such that when the arrow is in place and the slide is then moved aft to snap into the cradle, the arrow is fully constrained in motion such that even when fishing from an unstable platform, the arrow will not come away from the riser and the result is increased safety as well as increased shot accuracy.

In one embodiment of the subject invention a stop in the form of a washer or disc is positioned at the end of the arrow ahead of the nock, such that when the arrow is released the arrow moves through the slide until such time as the disc contacts the rear portion of the slide, at which point the slide and the disc move as a unit with the arrow out from being snapped into the cradle, with the slide and the disc moving along with the arrow to its intended target.

It will be appreciated that a line or string that is attached to the arrow is attached to the slide as in the case of the aforementioned patent. However, it makes no difference if the slide is aft of the bow riser, as safety is not a problem due to the mating slide/cradle configuration.

It will be appreciated that the arrow is pre-assembled with the subject slide and stop, and is snapped into the cradle.

Note that the slide may freely translate on the arrow shaft. Thus when mounting the arrow to the bow positions the arrow shaft in the cradle and thereafter moves the slide aft on the arrow shaft such that the slide snaps into the cradle. In one embodiment the cradle is C shaped to permit easy positioning of the arrow shaft in the cradle prior to snapping the slide into the C shaped cradle.

It will be appreciated from a safety point of view that the string or line attached to the snapped in slide cannot interfere with either the human being using the bow or any of the bow parts due to the fact that the line is led in front of the riser from the fixed position of the snapped-in slide.

Once the arrow is released, the arrow shaft translates forwardly through the captured slide until such time that the stop engages the rear portion of the slide and unsnaps the slide from the cradle at which point the arrow and slide move forwardly in unison as the arrow starts its flight.

Aside from the safety issues and the ability to tightly constrain the arrow against the riser prior to releasing the arrow, it has been found that the string provides aerodynamic stability for the arrow during flight once the arrow and slide have left the cradle.

This aerodynamic stability is in part due to the trailing of the line after the arrow but also is due to the aerodynamic properties of the slide as the arrow moves through the air. It will be appreciated that the inflight balance of the arrow is such that the slide creates a slight drag on the arrow as it flies such it tends to straighten out the arrow during flight. This occurs whether or not there is a string attached to the slide and as a result it has been found that the use of the translatable slide on the arrow can replace the fletchings which are normally used to stabilize arrow flight. Thus, the slide having moved to the end of the arrow during flight serves the same function as the fletchings without the problem of attaching fletchings to the arrow shaft, involving intricate manufacturing steps, all of which can be avoided if the arrow is provided with the subject slide.

It is noted that the inner diameter of the cradle provides clearance for the disc stop at the end of the arrow such that by snapping the slide in the cradle and with the diameter of the disc being less than the diameter of the slide, the disc does not in any way come into contact with the cradle walls as the arrow is released.

While in one embodiment of the invention the slide has a circumferential notch that communicates with an inwardly directed rib in the cradle, the reverse is possible such that the slide may have an outwardly directed circumferential rib which communicates with an inwardly directed channel in the cradle.

As to the cradle construction itself, in one embodiment as mentioned before the cradle is a C shaped structure which has an outer C shaped shell in which is captured a compliant deformable or resilient C shaped member that captures the slide when pressed into the cradle. In general, the deformable member may be of rubber or other resilient material which will deform but yet has memory.

In order to prevent the slide from moving through the cradle and aft of the cradle, the slide is provided with an annular shoulder at the forward portion of the slide which coacts with the cradle so that the slide can be pushed only so far through the cradle at which point the shoulder mates with a cradle lip, thereby providing a safe slide snap in procedure.

Note that the cradle which incorporates the compliant material is mechanically attached to the riser of the bow. Note also that the slide in one embodiment is a hard plastic piece that has a low coefficient of friction so that it may translate easily on the arrow shaft.

In one embodiment the C shaped shell contains a compliant member of urethane or a thermo polymer chosen for abrasion resistance. It is relatively strong yet less expensive to manufacture than some of the alternative rubber materials. Note that the compliant material in the cradle may also be made out of silicone as well as for instance vulcanized rubber. The compliant material may also be made of a soft vinyl material. However, with urethane provides better abrasion resistance and strength.

In summary what is provided is an arrow shaft mounted slide that is releasably snapped into a cradle carried by the riser of a bow, in which the slide cradle combination provides a tight arrow rest as well as an anchoring mechanism for one end of the line when used for bowfishing. The arrow shaft provided is provided with a stop at its distal end such that when the arrow is released the stop contacts the slide, unclips it from the cradle, thus permitting the slide and arrow to move out of the cradle. The slide/cradle structure locks the arrow adjacent the bow riser prior to arrow release, with the slide providing for aerodynamic stability after release of the arrow. The use of the slide may also replace the fletchings normally used at the distal end of the arrow to provide the same type of aerodynamic stability as fletchings presently provide. Thus, the slide cradle combination can be used for both bowfishing and bowhunting.

BRIEF DESCRIPTION OF THE DRAWINGS

These and other features of the subject invention will be better understood in connection with the Detailed Description, in conjunction with the Drawings, of which.

DETAILED DESCRIPTION

Figure 1:
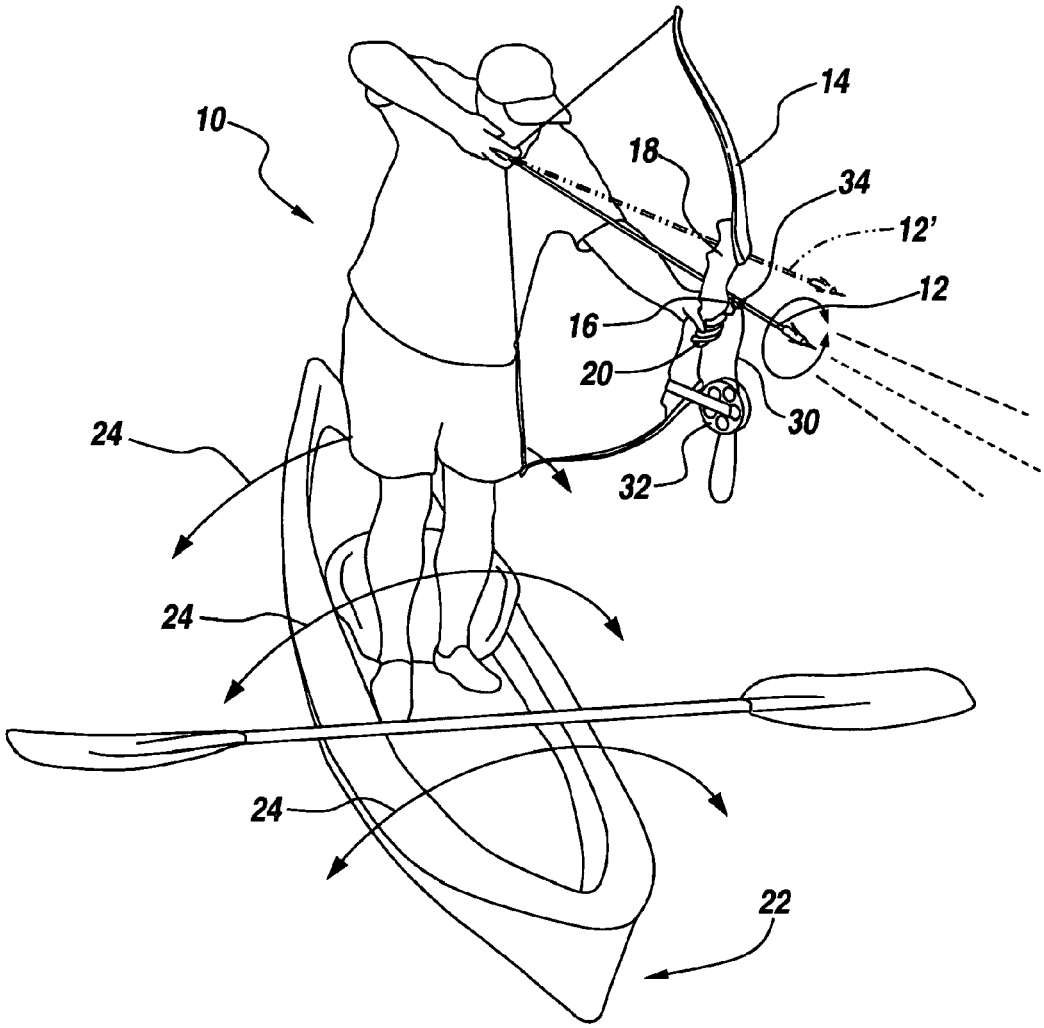
FIG. 1 is a diagrammatic illustration of a bowfisherman firing his arrow from an unstable platform showing the possibility that the arrow will come away from the bow riser.

Referring now to FIG. 1, an archer 10, in this case a bowfisherman, is shown aiming an arrow 12 utilizing a bow 14 in which the arrow 12 may come out as shown at 121 from a position 16 against the riser 18 of bow 12 such that it is not controlled by the bow. The reason that the arrow may become dislodged from the rest formed by the archer's hand 20 may be the unstable platform 22 in the form of a canoe or kayak or the like, in which the kayak may roll from side to side as illustrated by double ended arrows 24.

The instability of the platform is an important factor in bowfishing due to the fact that most bowfishermen utilize small skiffs or boats.

As illustrated, a line 30 is attached to arrow 12, with line 30 paying out from a reel 32 such that when the arrow is released the line travels out with the arrow to the intended target.

The problem with this arrangement is not only that the arrow may fall off the arrow rest formed by the person's hand or a small extension 34 from the riser of the bow, it also may be that line 30 may be caught either on the person or on some portion of the boat or paddle such that if the line is not properly controlled injury can occur to the archer or to the boat itself. Further, with the arrow may be defected if the line gets tangled.

Figure 2A:
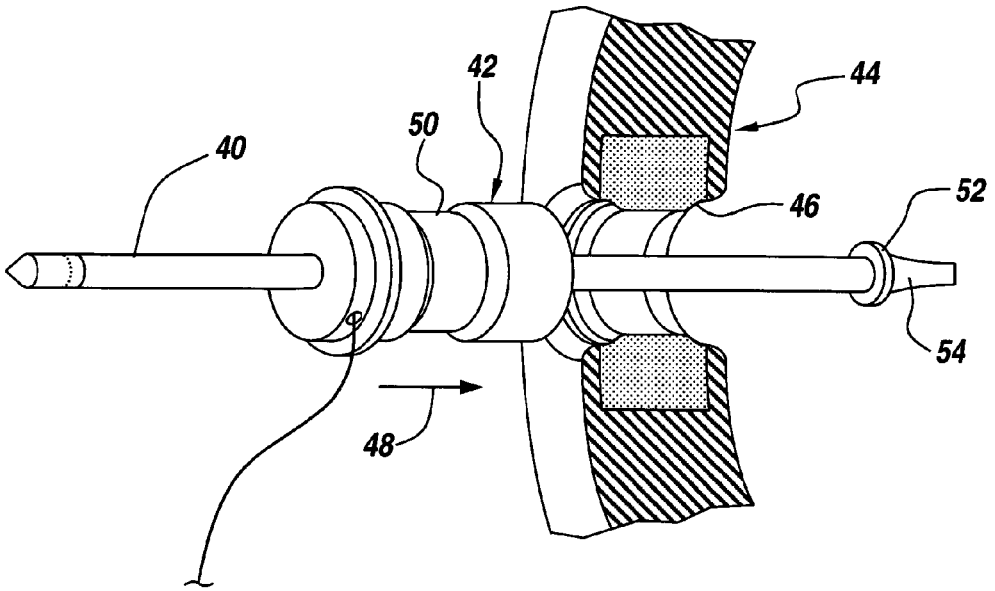
FIGS. 2A and 2B show the combination of a slide mounted for translation on an arrow and a cradle into which the slide snaps prior to releasing the arrow, with the slide serving as an anchor for a retrieval line or string.
Figure 2B:
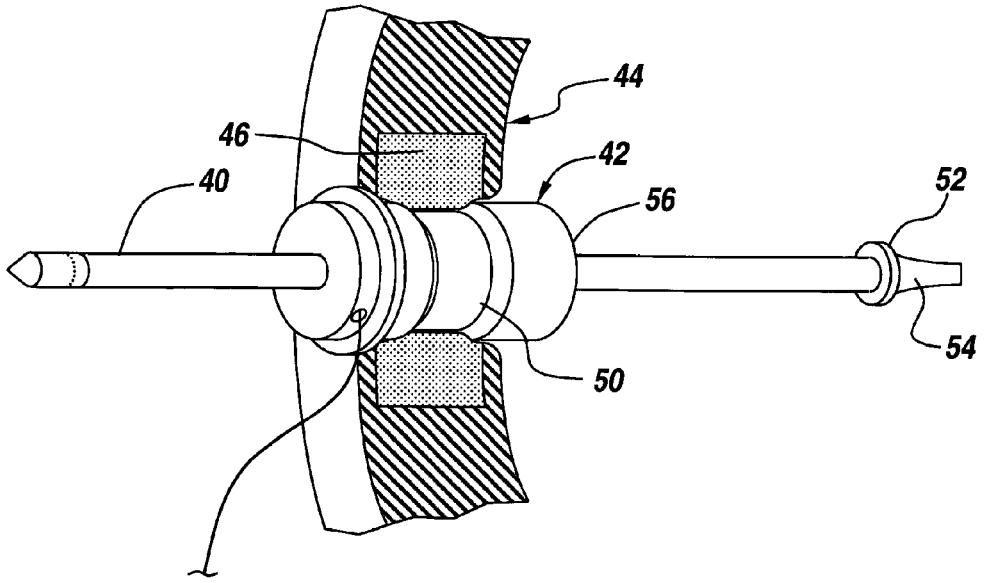

Referring now to FIGS. 2A and 2B, an arrow 40 is provided with a slide 42 which is captured in a cradle 44 which in one embodiment includes an resilient elastomeric member 46 such that when the slide 42 is moved in the direction of arrow 48 the slide is captured in the cradle at a recess 50 on the slide.

Referring to 2B what is seen is slide 42 captured in cradle 44 due to the coaction of resilient member 46 with groove 50 in the slide. As will be discussed hereinafter the arrow is provided with a disc shaped stop 52 which is mounted ahead of nock 54 on arrow 40 such that when the arrow is released stop 52 strikes the distal end 56 of the slide to unsnap the slide and the arrow from the cradle as it moves out from the bow.

Figure 3:
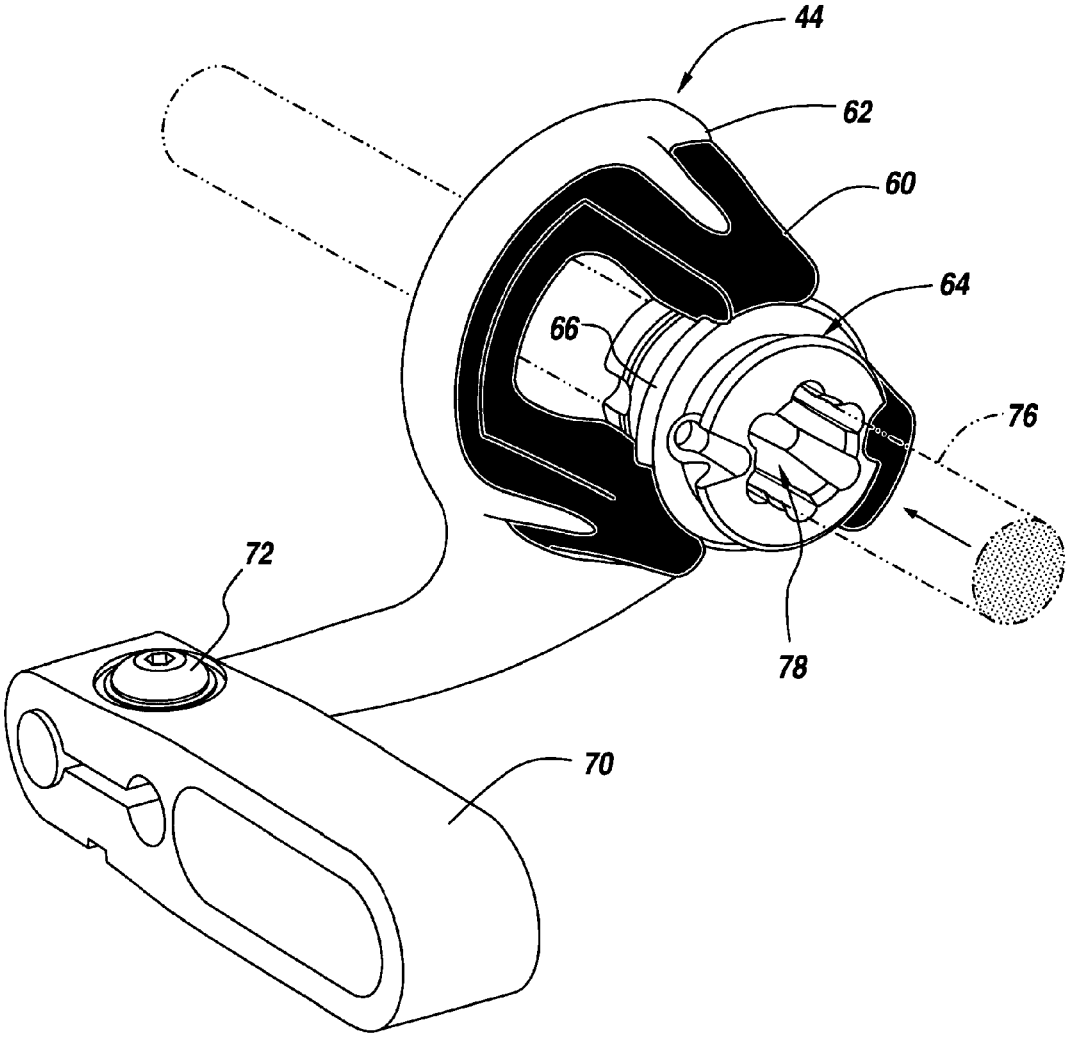
FIG. 3 is a diagrammatic illustration of one embodiment of the combined slide and cradle combination showing the slide captured in a resilient member of the cradle which is in turn captured in a rigid frame to be mounted to the bow riser.

Referring now to FIG. 3, in one embodiment cradle or arrow rest assembly 44 can include a resilient elastomeric member 60 which has a hard supporting polymeric material 62 that releasably secures slide 64 at a number of features 66 on the slide such that when slide 64 is snapped into cradle 44 the elastomeric member clamps down on features on the slide and releasably holds the slide in the cradle. Here the cradle is attached to a bow through a mount 70 which is clamped around the riser 81 of a bow 82 by a bolt 72 such that the cradle along with its elastomeric member is held slightly behind the riser of the bow which passes through orifice 74 in mount 70. As seen in dotted outline 76 the arrow passes through an orifice 78 in slide 64 so that the arrow position with respect to the bow is locked in place due to the snap action of the slide and the cradle. In the preferred embodiment, cradle 44 is a co-molded product in which the hard polymeric portion 62 is overmolded with the elastomeric portion 60 for an integral unit in manufacturing.

Figure 4A:
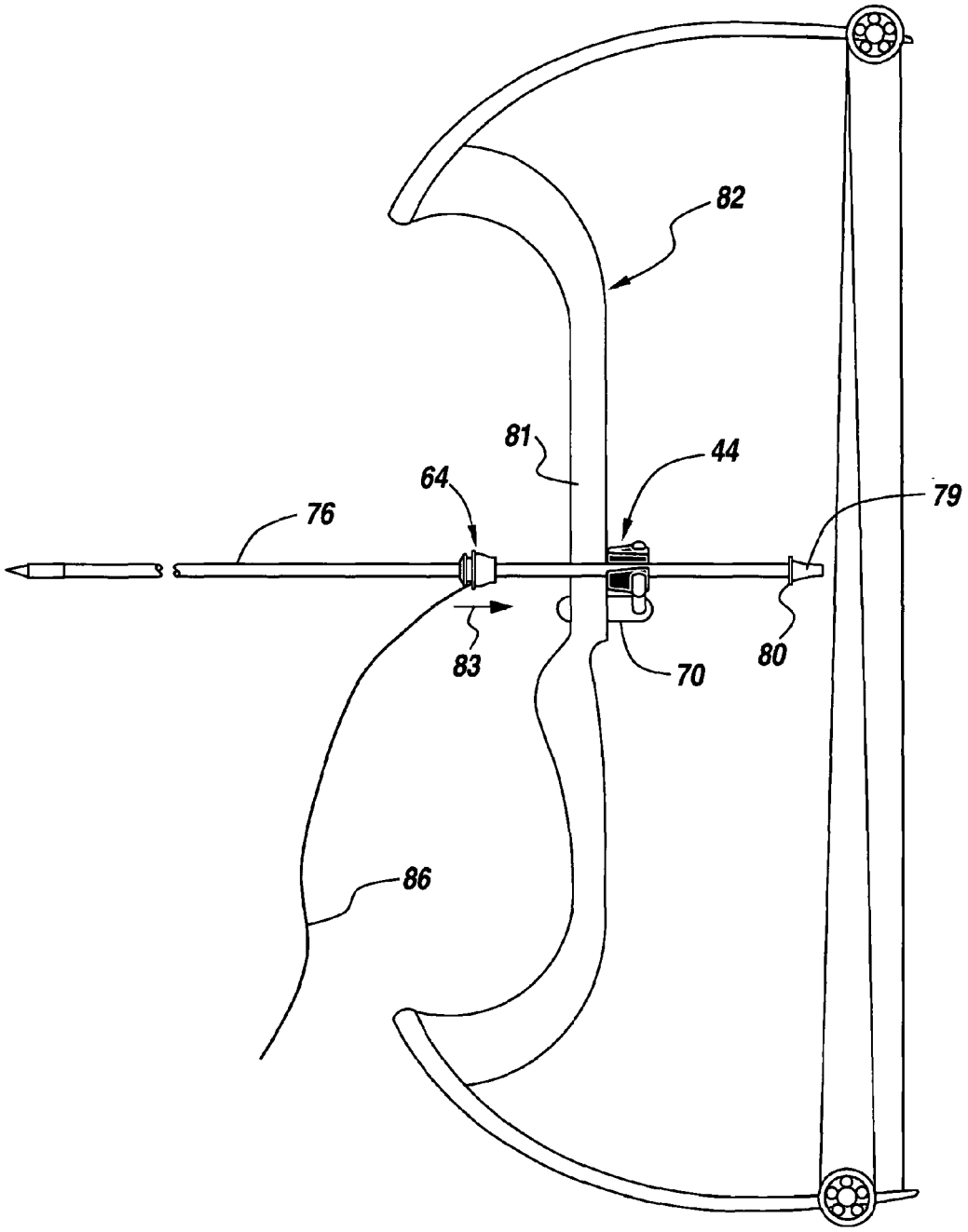
FIGS. 4A-4E are diagrammatic illustrations of the utilization of the slide/cradle combination in operation showing the placement of the arrow in the cradle, the snapping of the slide into the cradle, the drawing of the arrow rearwardly through the snapped in cradle, the release of the arrow such that the arrow moves back through the slide and cradle, with a stop at the distal end of the arrow to contact the distal end of the slides; and the unsnapping of the arrow and slide with the movement of the released arrow through the slide and cradle.

Referring to FIG. 4A, slide 64 is mounted on arrow 76 ahead of the riser 81 of bow 82 such that cradle 44 is positioned aft of riser 81. Here it can be seen that arrow 76 is provided with a nock 79 and a stop 80 in the form of a disc shaped washer adjacent the nock. As shown the arrow is first inserted into cradle 44, in this case a C shaped cradle which permits easy entry, with slide 64 moved in the direction of 83 until such time as it is captured in cradle 44. It will be noted in this embodiment that a line or string 86 is affixed to the forward end of slide 64 for retrieval of the arrow and the fish after the arrow has been released and strikes its target.

Figure 4B:
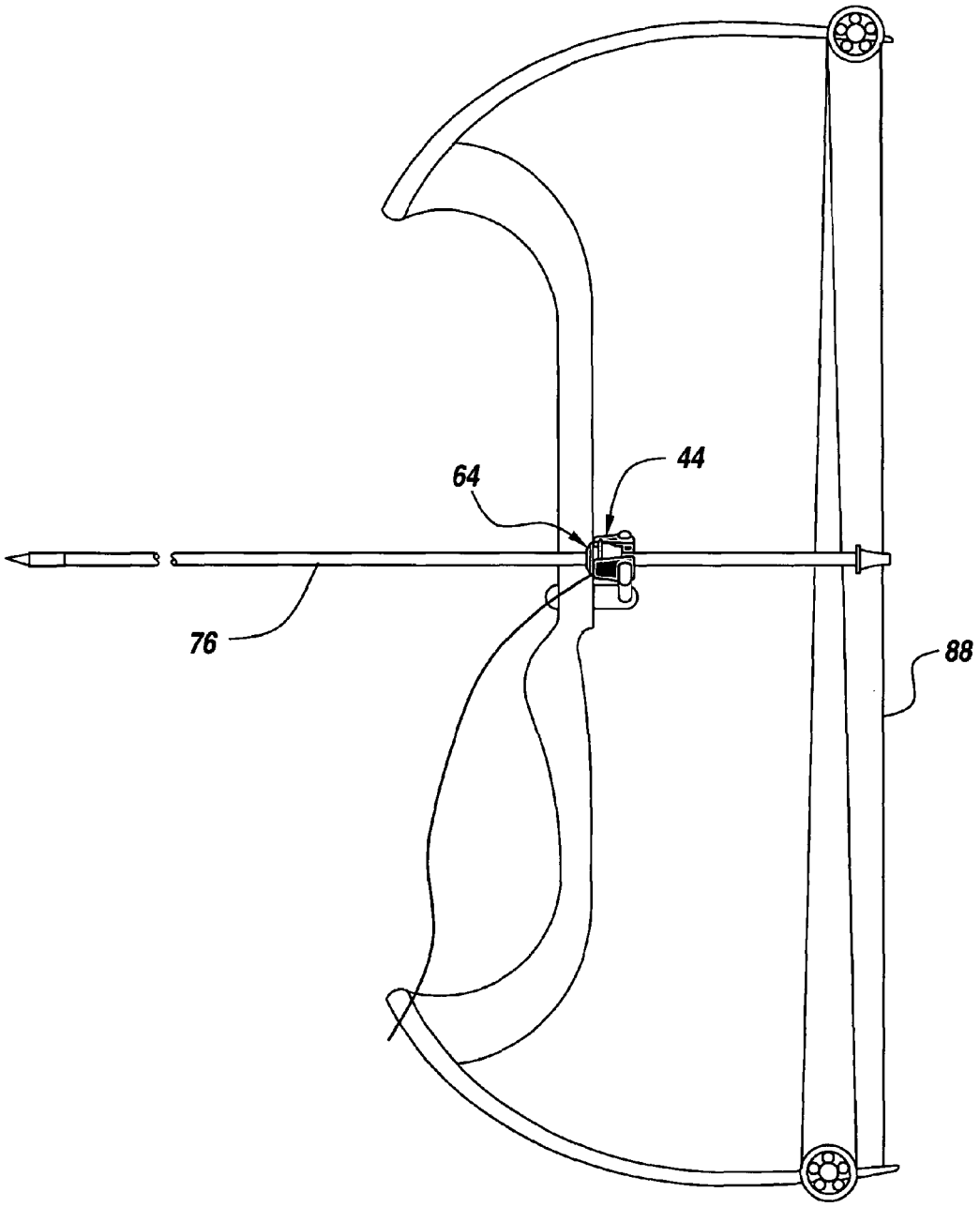

Referring to FIG. 4B, what is shown is that slide 64 is releasably captured in cradle 44 prior to the time that arrow 76 is drawn backwardly against bow string 88.

Figure 4C:
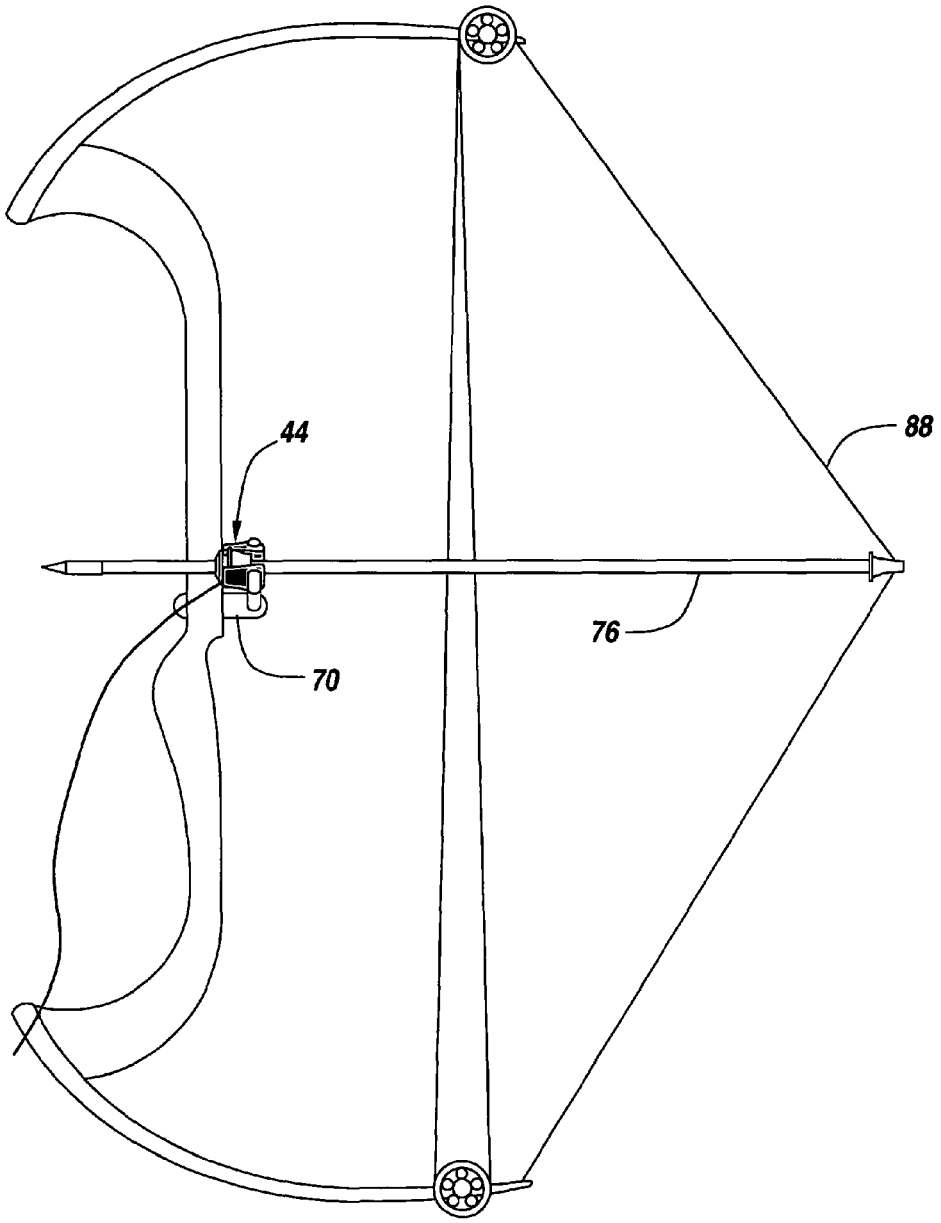

Thereafter as illustrated in FIG. 4C arrow 76 is moved aft against bow string 88.

Here it can be seen that arrow 76 has moved through cradle 44 due to the fact that the arrow can slide easily through the captured slide.

Figure 4D:
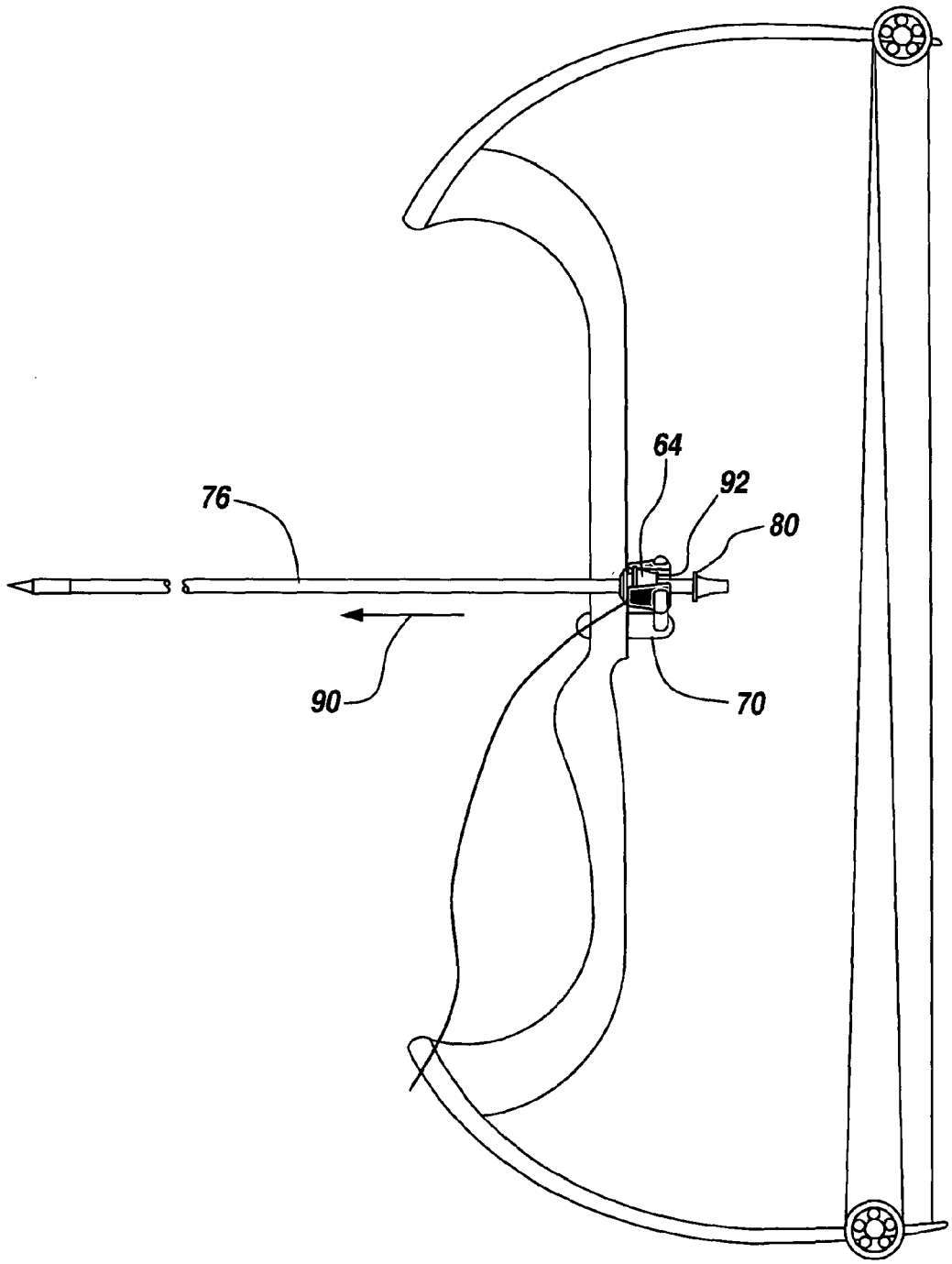

Referring now to FIG. 4D, the situation is shown where arrow 76 has been released and travels in the direction of 90 such that the stop 80 is shown just prior to impacting the back end 92 of slide 64.

Figure 4E:
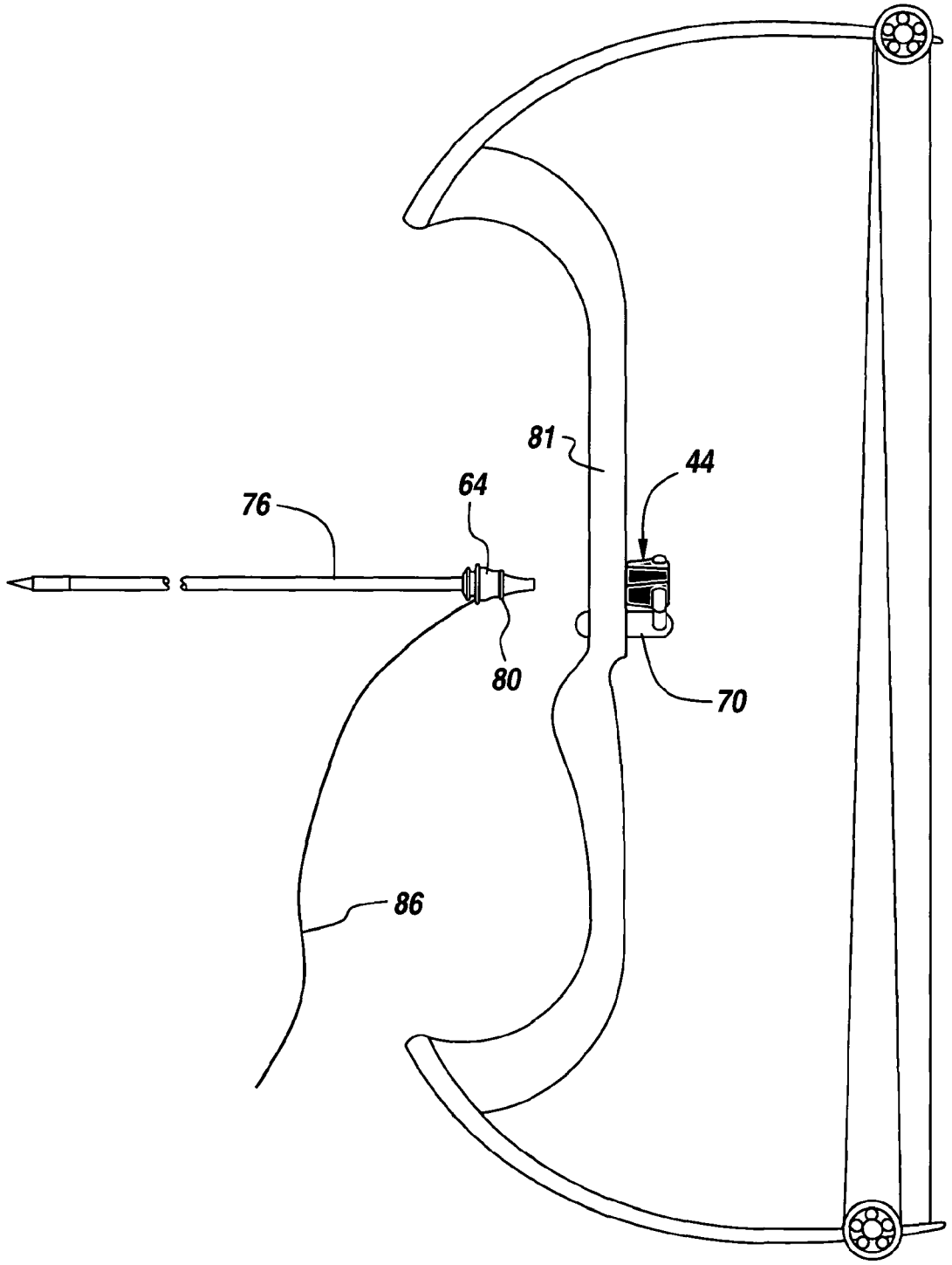

Referring to FIG. 4E, slide 64 exits cradle 44 due to stop 80 striking the slide such that the slide slides back to the end of the arrow as the arrow moves out of the bow. Here it can be seen that line 86 is affixed to slide 64 and as it trails behind the arrow during flight it stabilizes the arrow as does the wind resistance against slide 64. Thus, slide 64 and line 86 provide both aerodynamic and hydrodynamic stabilizing of the arrow when the arrow enters the water.

What will be seen is that while cradle 44 is behind riser 87 it nonetheless prevents line 86 from getting entangled in the bow or in fact the archer's hand, thus providing a safety feature not heretobefore provided. Moreover, the clamping of the arrow into cradle 44 provides that the arrow is clamped to the bow prior to release, thus to permit accurate aiming and release and also to prevent the arrow from coming away from riser 81 during the firing of the bow. In short, the mating arrow-mounted slide and cradle form a secure arrow rest to clamp the arrow to the riser.

It will be appreciated that while the subject invention has been described in connection with bowfishing, absent line 86 the combined slide and cradle form a particularly tight arrow rest for use in bowhunting as well, with the slide providing an aerodynamic stabilizing element for the arrow during flight in the bowhunting situation as well.

Figure 5A:
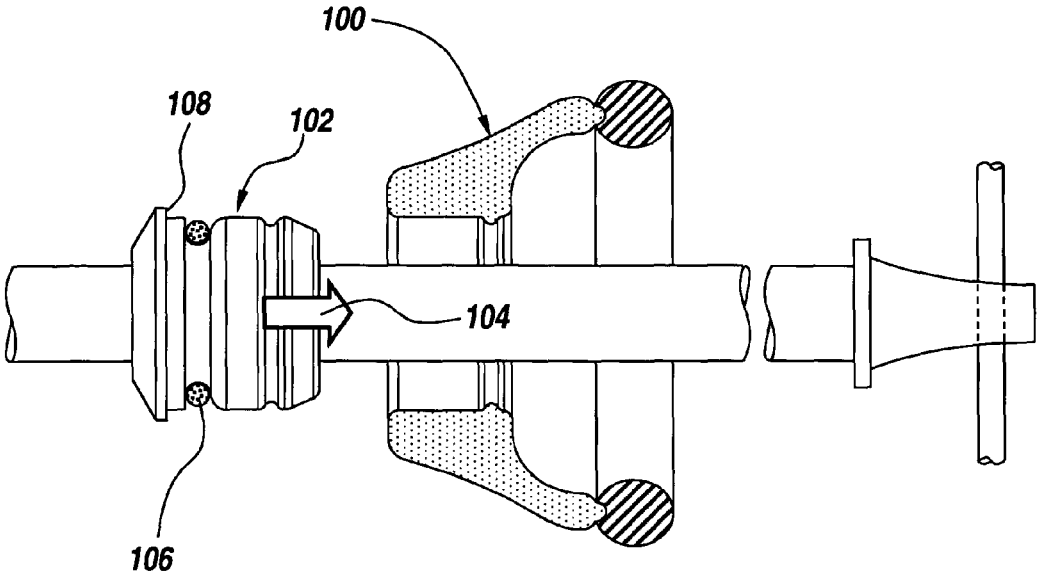
FIGS. 5A-5G are diagrammatic illustrations of the subject slide and cradle first showing the movement of the slide along the arrow shaft in the direction of the resilient member of the cradle, the snapping of the slide into the cradle where it is releasably captured, also showing the movement of the arrow backwardly towards the string for the drawing of the string, the drawing of the string which draws the arrow rearwardly along with a disc shaped stop at the end of the arrow, the release of the arrow showing the motion of the arrow and disc shaped stop moving towards the slide in the cradle, the motion of the arrow with the disc shaped stop just prior to the disc shaped stop contacting the distal end of the slide, the contacting of the disc shaped stop with the distal end of the slide as the arrow moves forward, and the movement in unison of the slide and the arrow as it exits the cradle.
Figure 5B:
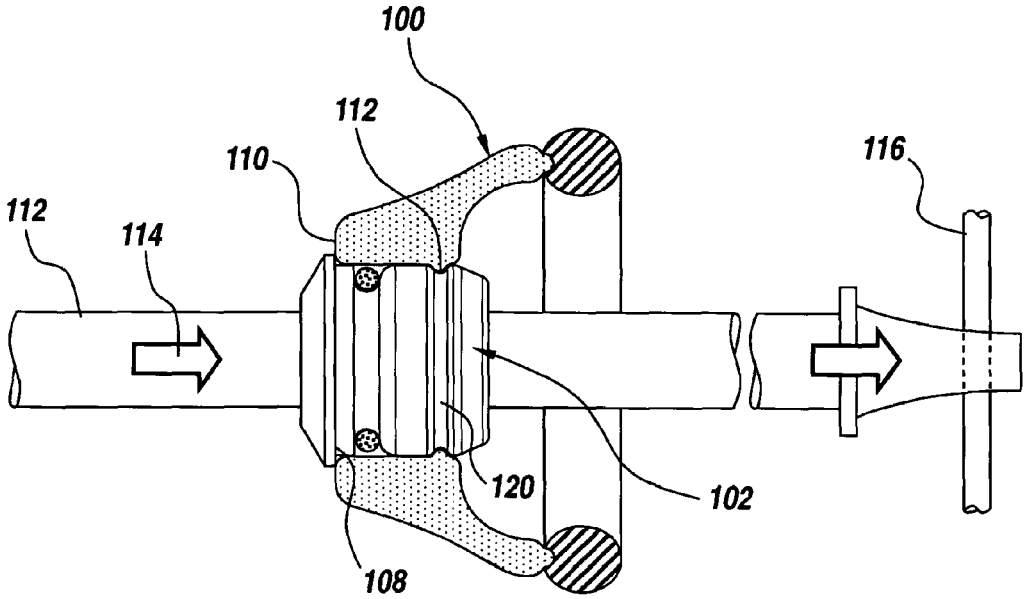
Figure 5C:
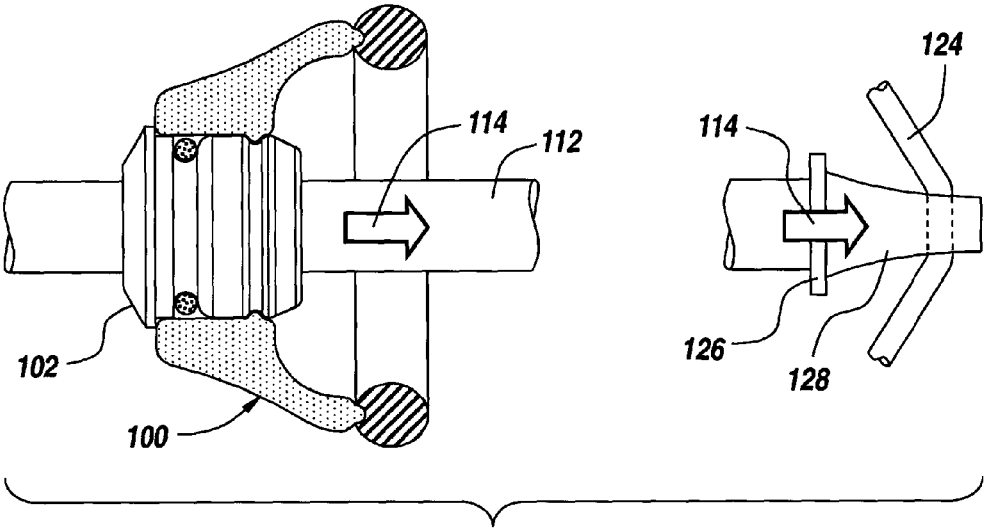

In one embodiment of the subject invention the slide may have an elastomeric member 100 as illustrated in FIG. 5A into which slide 102 is positioned when the slide is moved in the direction of arrow 104. Here line 106 is mounted to the forward portion of slide 102, with the slide being provided with an annular stop 108 that communicates with a shoulder 110 of elastomeric member 100 to emit rearward slide movement when the arrow 112 is moved in the direction of arrow 114 as the arrow is pulled back against bow string 116. Here stop 108 comes into contact with shoulder 110 when slide 102 is moved into the elastomeric member portion of the cradle.

As can be seen in this embodiment an annular notch 120 cooperates with an inwardly directed ridge 122 in elastomeric member 100 so as to capture slide 102 in the elastomeric member portion of the cradle.

After slide 102 is releasably captured in elastomeric member 100 arrow 112 is drawn back as illustrated by arrows 114 against bow string 124, with the arrow having a disc shaped stop 126 just ahead of nock 128.

Figure 5D:
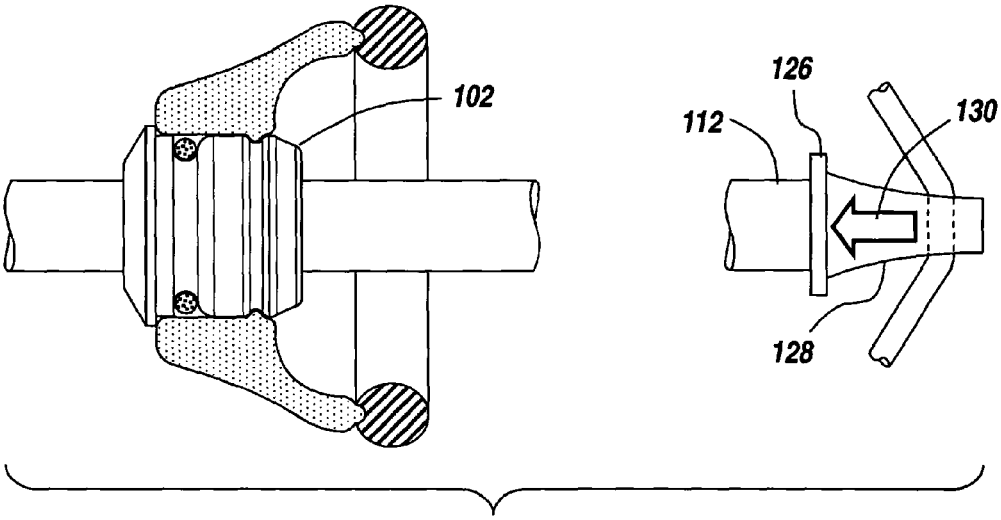
Figure 5E:
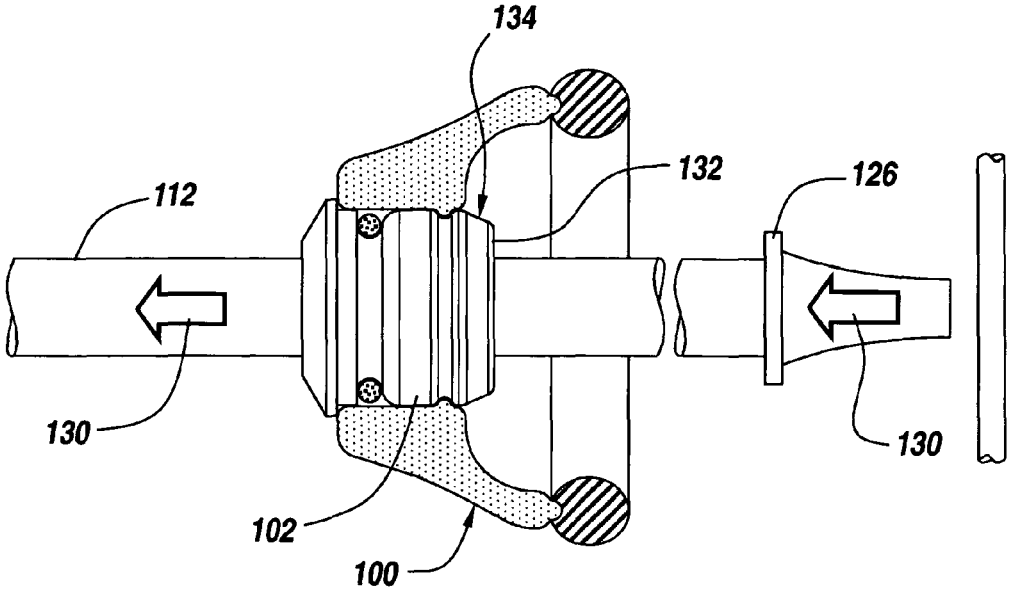
Figure 5F:
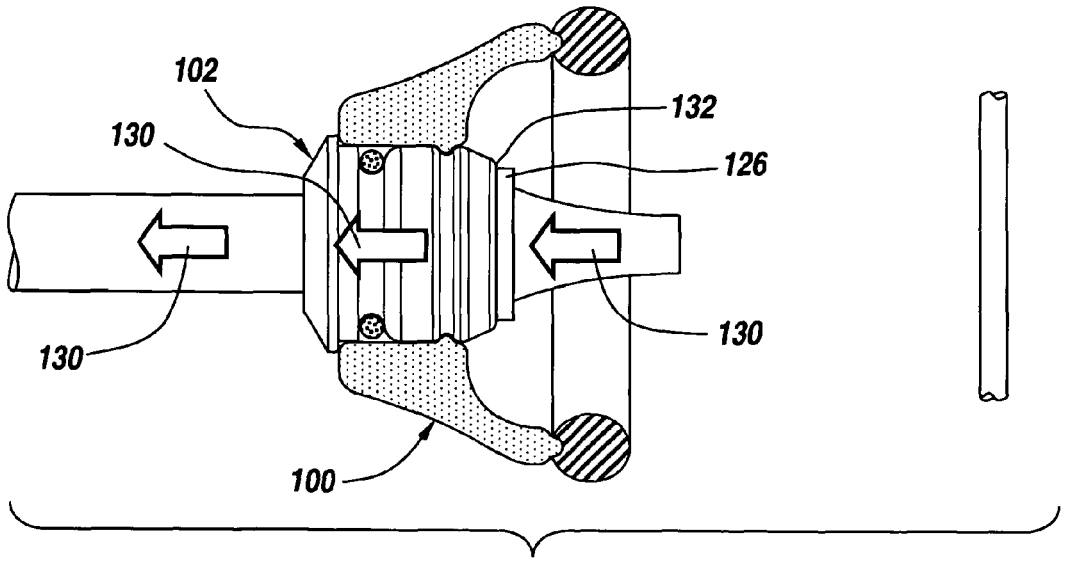

As illustrated in FIG. 5D, upon release arrow 112 stop 126 and nock 128 move in the direction of arrow 130 towards slide 102. As illustrated in FIG. 5E as the arrow 112 moves in the direction 130, stop 126 also moves in the direction of 130 towards the back or distal end 132 of slide 102. It will be noted that the diameter of stop 126 is less than the diameter of aperature 134 in the distal end 132 of slide 102 so that when stop 126 impacts the distal end of slide 132 it will pass through the aperture 134 of 100 as it unsnaps slide 102 away from elastomeric member 100 as shown in FIG. 5F with the contact of stop 126 against distal end 132 of slide 102 dislodging the slide.

Figure 5G:
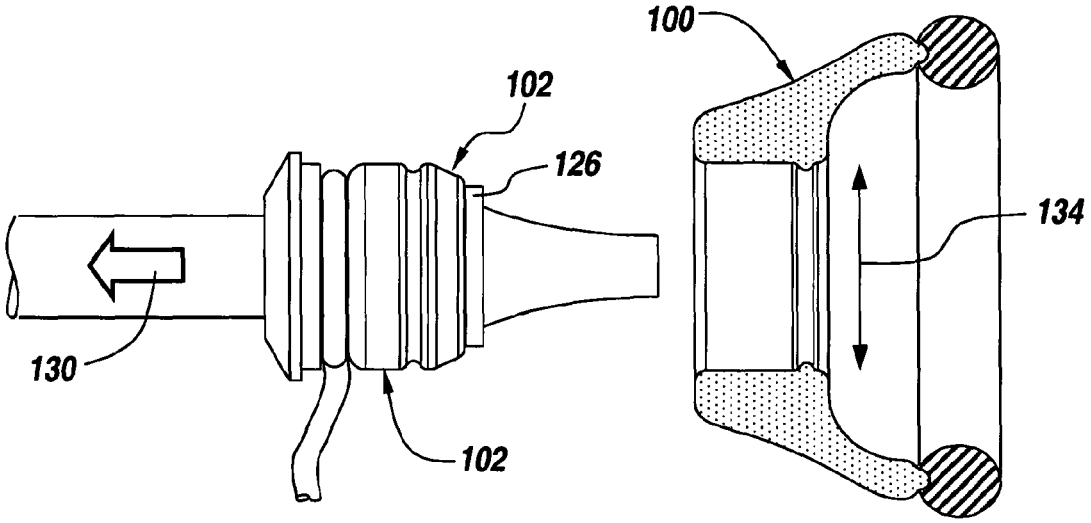

Finally as illustrated in FIG. 5G, slide 102 exits elastomeric member 100 and carries slide 102 in unison with the end of the arrow as the arrow moves in direction 130.

Due to the sizing of stop 126 and the diameter of slide 102 it will be seen that there is sufficient clearance for stop 102 to move through cradle elastomeric member 100 and the aperature 134 thereof.

Figure 6:
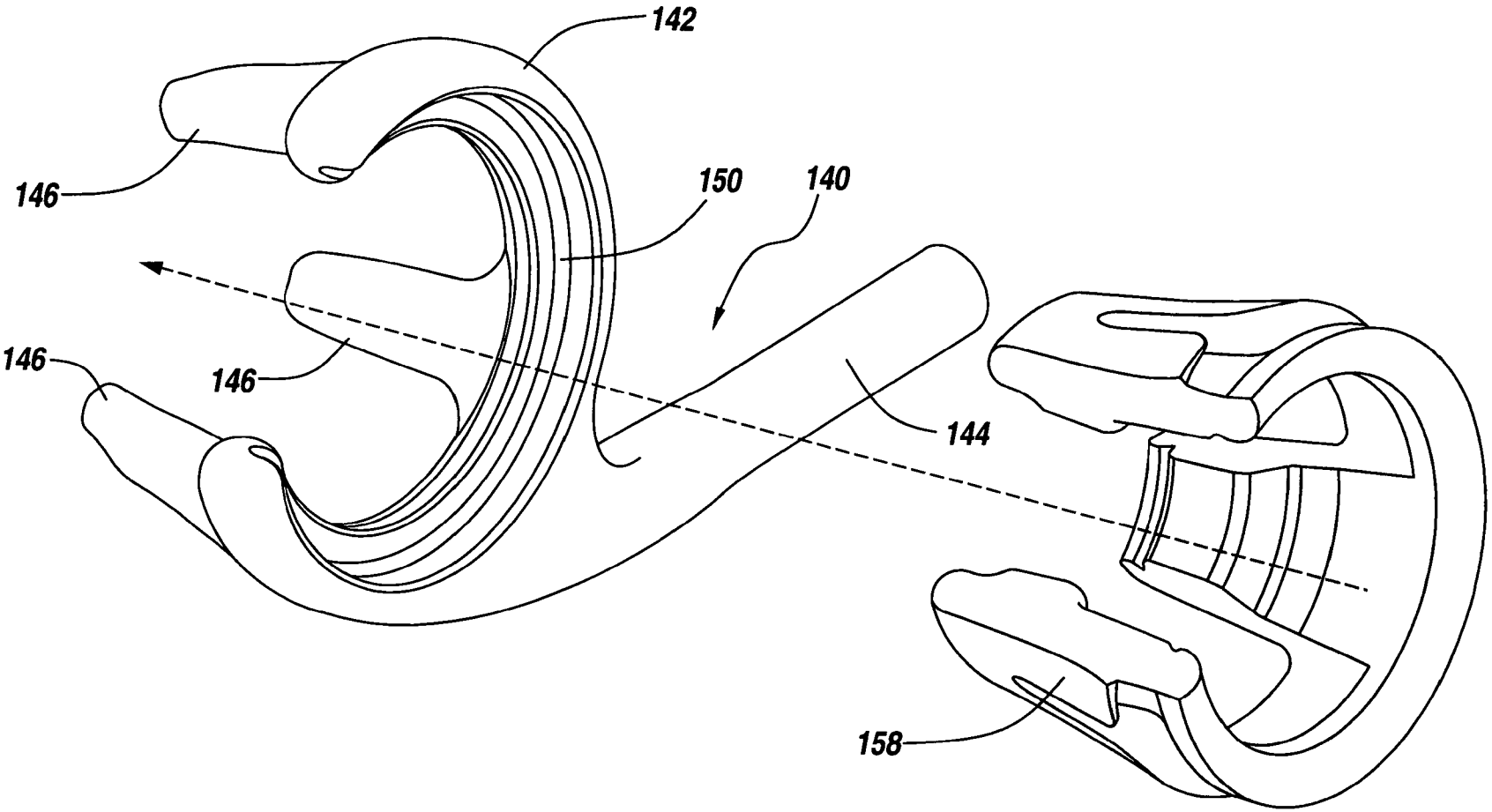
FIG. 6 is an exploded view of the construction of one embodiment of the cradle illustrating a resilient member to be inserted into a rigid plastic or metal frame on an arm to be attached to the bow.

Referring now to FIG. 6, elastomeric member 100 of FIG. 5 is shown separated from a hard plastic or metal frame and arm structure 140 which includes a C shaped frame portion 142 mounted to an arm 144 to be mounted to the riser of the bow.

Here frame 142 has three rigid extensions 146 which extend forwardly of frame 142 as illustrated. When elastomeric member 100 is inserted into frame 142 it is locked in place as illustrated in FIG. 7 by internal ridges 150 of frame 142 and by its mating with extensions 148 such that the elastomeric member is held tightly within frame 142 that is again held tightly to the riser of the bow by means of mount 154.

Figure 7:
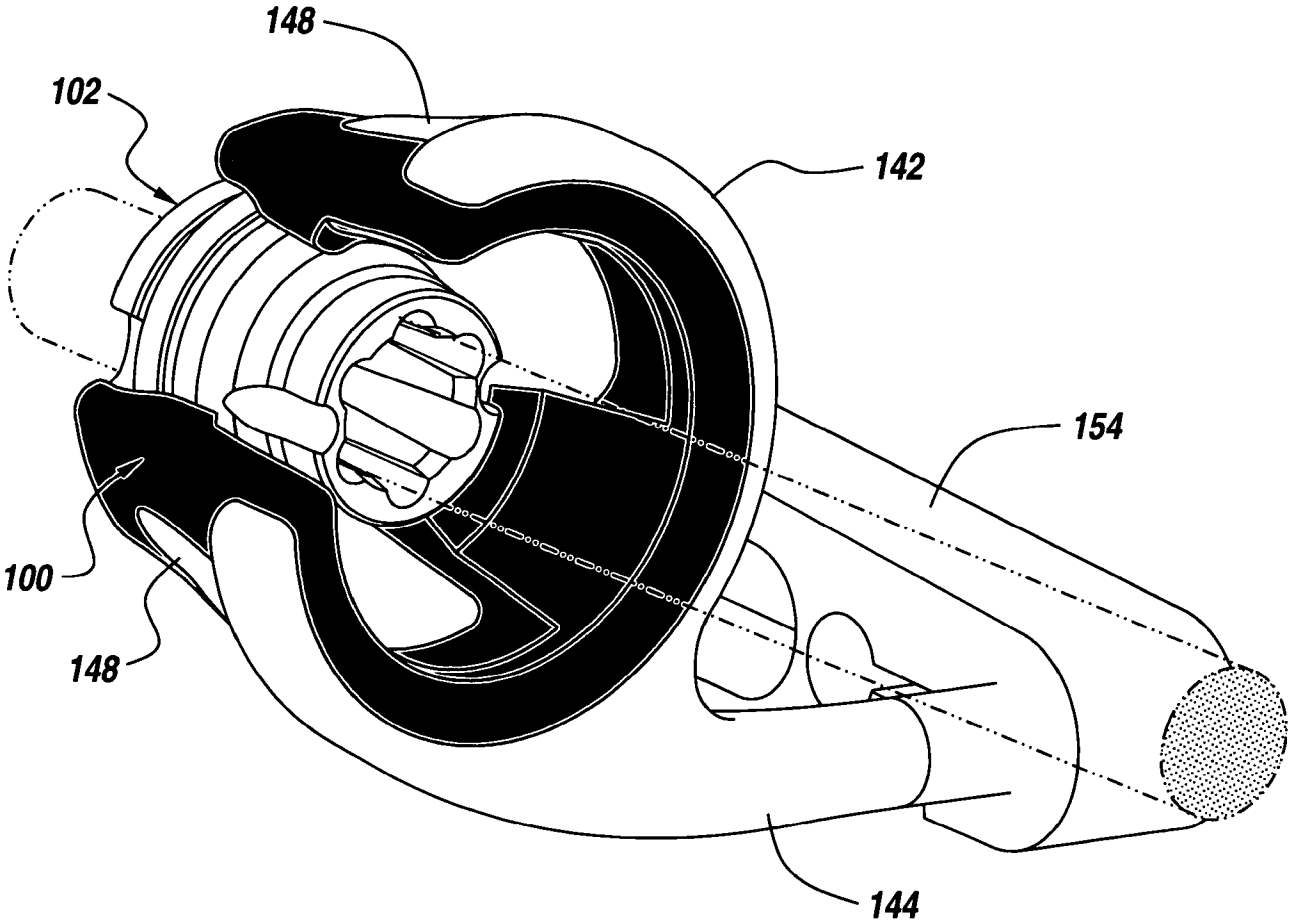
FIG. 7 is an end view of the cradle illustrating the position of the resilient member within the solid portion of the cradle of FIG. 6, also showing the insertion of the slide therein.

Also shown in FIG. 7 is the capture of slide 102 in the elastomeric member.

Figure 8:
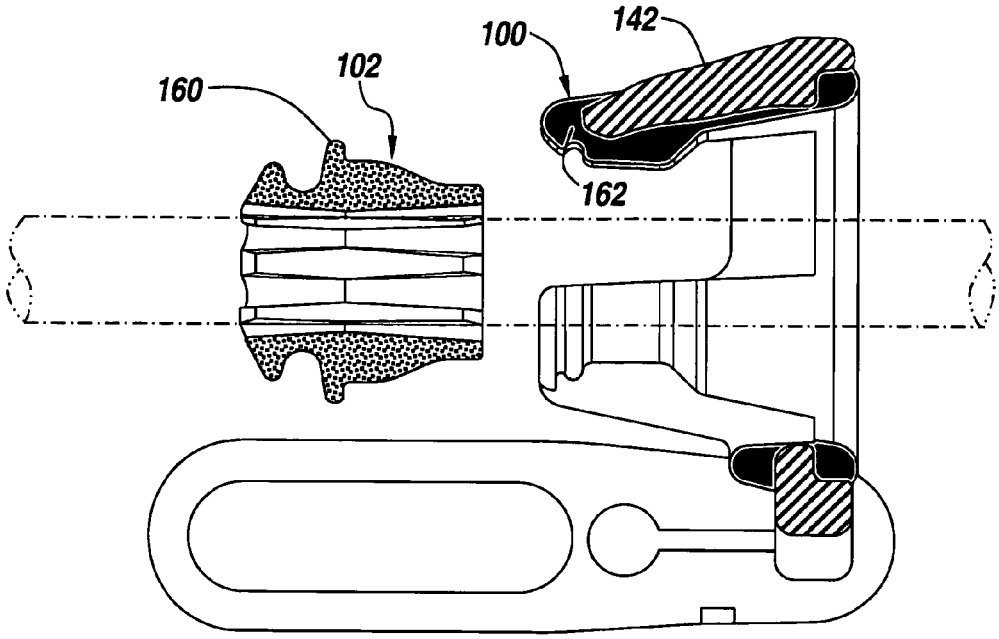
FIG. 8 is a cross-sectional view of a second embodiment of the slide prior to being inserted into the cradle, with the cradle having a resilient member as an interior portion thereof and in which the slide has an outwardly projecting ridge which communicates with a slot within the elastomeric member of the cradle.

Referring to FIG. 8, in another embodiment slide 102 is provided with an outwardly depending ridge structure 160 which cooperates with an annular ridge 162 in elastomeric member 100 which is in turn captured in cradle frame 142.

Figure 9:
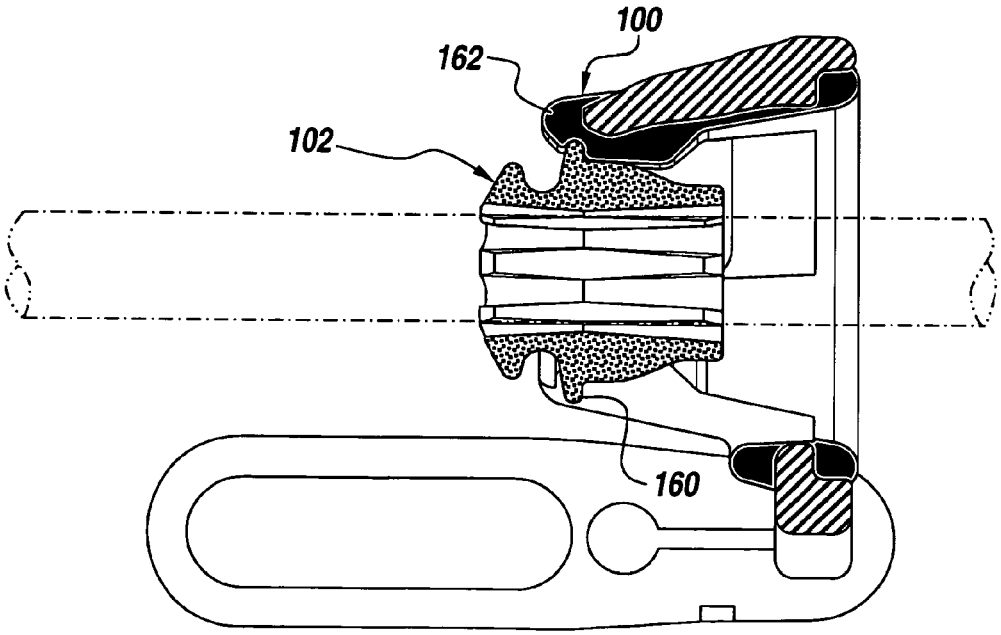
FIG. 9 is a cross-sectional view of the second embodiment of FIG. 8 showing the insertion of the slide into the cradle and the capture of the slide in the resilient cradle member.

As illustrated in FIG. 9 slide 102 is captured in elastomeric member 100 by the forcing of annular ridge 160 into annular slot 162. The result is the capture of the slide in the cradle in the same manner as depicted in FIGS. 5A through 5F albeit with a reversal in the capturing structure such that the slide now has an outwardly projecting ridge which mates with an inwardly directed channel in the elastomeric member.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An apparatus comprising:

a slide configured to be mounted on an arrow, wherein an outer surface of the slide comprises an annular notch; and a cradle configured to be attached to a riser of a bow, wherein an inner surface of the cradle comprises an annular ridge configured to fit within the annular notch.

2. The apparatus of claim 1, wherein the cradle is configured to be positioned aft of a forward surface of the riser of the bow.

3. The apparatus of claim 1, further comprising a stop configured to be mounted on the arrow.

4. The apparatus of claim 1, wherein the stop comprises a washer.

5. The apparatus of claim 1, wherein the slide comprises a plastic, and the cradle comprises urethane, silicone, rubber, or vinyl.

6. An apparatus comprising:

a slide configured to be mounted on an arrow, wherein an outer surface of the slide comprises an annular ridge; and a cradle configured to be attached to a riser of a bow, wherein an inner surface of the cradle comprises an annular notch configured to capture the annular ridge.

* * * * *